US008372221B2

(12) United States Patent
Kojima et al.

(10) Patent No.: US 8,372,221 B2
(45) Date of Patent: Feb. 12, 2013

(54) MANUFACTURING METHOD OF STEEL SHEET FOR CANS

(75) Inventors: Katsumi Kojima, Hiroshima (JP); Takumi Tanaka, Hiroshima (JP); Masaki Tada, Hiroshima (JP); Makoto Aratani, Chiba (JP); Hiroki Iwasa, Kanagawa (JP)

(73) Assignee: JFE Steel Corporation (JP)

( * ) Notice: Subject to any disclaimer, the term of this patent is extended or adjusted under 35 U.S.C. 154(b) by 50 days.

(21) Appl. No.: 13/141,129

(22) PCT Filed: Dec. 22, 2009

(86) PCT No.: PCT/JP2009/071844

§ 371 (c)(1),
(2), (4) Date: Jul. 25, 2011

(87) PCT Pub. No.: WO2010/074308

PCT Pub. Date: Jul. 1, 2010

(65) Prior Publication Data

US 2011/0272066 A1 Nov. 10, 2011

(30) Foreign Application Priority Data

Dec. 24, 2008 (JP) ..... 2008-327064

(51) Int. Cl.
*C21D 8/02* (2006.01)

(52) U.S. Cl. ..... 148/603; 148/650; 148/651

(58) Field of Classification Search ..... 148/603, 148/650, 651
See application file for complete search history.

(56) References Cited

U.S. PATENT DOCUMENTS

| | | | | |
|---|---|---|---|---|
| 4,441,936 | A * | 4/1984 | Takahashi et al. | 148/603 |
| 5,078,809 | A * | 1/1992 | Kinoshita et al. | 148/603 |
| 5,587,027 | A * | 12/1996 | Tosaka et al. | 148/320 |
| 5,738,738 | A * | 4/1998 | Yoon et al. | 148/603 |
| 6,743,306 | B2 * | 6/2004 | Nakajima et al. | 148/328 |
| 6,767,417 | B2 * | 7/2004 | Fujita et al. | 148/330 |
| 2008/0185077 | A1 * | 8/2008 | Yoon et al. | 148/603 |

FOREIGN PATENT DOCUMENTS

| | | | |
|---|---|---|---|
| JP | 4-280926 | A | 10/1992 |
| JP | 6-248339 | A | 9/1994 |
| JP | 8-041549 | A | 2/1996 |
| JP | 9-316543 | A | 12/1997 |
| JP | 10-046243 | A | 2/1998 |
| JP | 2000-199031 | A | 7/2000 |
| JP | 2001-064730 | A | 3/2001 |

* cited by examiner

*Primary Examiner* — Deborah Yee
(74) *Attorney, Agent, or Firm* — DLA Piper LLP (US)

(57) ABSTRACT

A method provides a slab by continuous casting of a steel having a component composition of, in mass %, C: 0.005% or less, Mn: 0.05 to 0.5%, Al: 0.01 to 0.10%, N: 0.0010 to 0.0070%, B: 0.15×N to 0.75×N (0.15 to 0.75 in terms of B/N), and one or both of Nb: 4×C to 20×C (4 to 20 in terms of Nb/C) and Ti: 2×C to l0×C (2 to 10 in terms of Ti/C), and the balance of Fe and inevitable impurity elements; rough rolling the slab; finish rolling the rough-rolled slab wherein 5% or more and less than 50% of the total amount of rolling reduction in the finish rolling is hot-rolled at a temperature lower than the $Ar_3$ transformation point; winding the hot-rolled steel sheet at a winding temperature of 640 to 750 ° C.; pickling the coiled steel sheet; cold rolling the pickled steel sheet at a rolling reduction rate of 88 to 96%; and annealing the cold-rolled steel sheet in a temperature range of higher than 400 ° C. to a temperature that is 20 ° C. lower than the recrystallization temperature.

1 Claim, No Drawings

MANUFACTURING METHOD OF STEEL SHEET FOR CANS

RELATED APPLICATIONS

This is a §371 of International Application No. PCT/JP2009/071844, with an international filing date of Dec. 22, 2009 (WO 2010/074308 A1, published Jul. 1, 2010), which is based on Japanese Patent Application No. 2008-327064, filed Dec. 24, 2008, the subject matter of which is incorporated by reference

TECHNICAL FIELD

This disclosure relates to a method of manufacturing a steel sheet for cans, having a high strength and being excellent in thickness accuracy.

BACKGROUND

Cans, such as beverage cans, food cans, 18-liter cans, and pail cans, are roughly classified into two-piece cans and three-piece cans, based on their manufacturing method (process).

In the two-piece can, a can bottom and a can body are integrally formed by, for example, a shallow drawing process, a drawing and wall ironing process (DWI process), or a drawing and redrawing process (DRD process) of a surface-treated steel sheet, which is provided with treatment such as tin plating, chromium plating, metal oxide coating, chemical conversion coating, inorganic film coating, organic resin film coating, or oil coating. Then, this is provided with a lid to give a can consisting of two parts.

In the three-piece can, a can body is formed by bending a surface-treated steel sheet into a round tube or a rectangular tube and jointing the ends thereof. Then, this is provided with a top lid and a bottom lid to give a can consisting of three parts.

In these cans, the ratio of material costs to can costs is relatively high. Therefore, to reduce the can costs, it is strongly required to reduce the costs of steel sheets. In particular, due to the recent steep rise in steel sheet prices, in the can manufacturing field, it has been tried to reduce material costs by using a steel sheet thinner than conventional ones. On this occasion, there is a demand for steel sheets having high strength to compensate for a decrease in can strength due to a decrease in the thickness.

For example, when an ultrathin steel sheet having an thickness of 0.14 to 0.15 mm is used, to ensure sufficient pressure capacity of the can body and the top and bottom lids of a three-piece can or the can bottom of a two-piece can, a strength of at least about 600 to 850 MPa in terms of tensile strength (TS) is necessary.

The presently existing ultrathin steel sheets for cans having high strength are manufactured by a double reduce method (hereinafter referred to as DR method) in which secondary cold rolling is performed after annealing. The strength of steel sheets mainly manufactured by the DR method is a level of 550 to 620 MPa in terms of TS. That is, the DR method is practically used for those having a strength level slightly lower than the strength of 600 to 850 MPa that is required in the above-mentioned steel sheets having thicknesses of about 0.14 to 0.15 mm. This is based on the following reasons.

That is, since the DR method strengthens a steel sheet by work hardening through secondary cold rolling, the organizational characteristics of the steel shows a high dislocation density. Therefore, the ductility is low. In a material having a strength of about 550 MPa, the total elongation (El) is about 4% or less, and in a material having a strength of about 620 MPa, it is about 2% or less. In some manufacturing examples, the steel sheet has a strength of about 700 MPa, but is very poor in ductility, such as an El of about 1% or less. Therefore, the steel sheet is used only in limited application that does not require machining thereof. That is, the steel sheet is not applied to a main use of steel sheets for cans, such as can bodies, top lids, and bottom lids of three-piece cans or two-piece cans.

In addition, as described above, in the DR method, steel sheets are manufactured through a process including hot rolling, cold rolling, annealing, and secondary cold rolling. That is, the process includes a larger number of steps than the common method that is completed at the step of annealing, and, therefore, the manufacturing cost thereof is high. Thus, the steel sheets obtained by the DR method not only have insufficient strength but also are inferior in ductility and high in manufacturing cost.

Accordingly, methods for solving these disadvantages of the conventional DR materials have been investigated.

For example, Japanese Unexamined Patent Application Publication No. 4-280926 discloses a method of manufacturing a steel sheet for cans, wherein Nb, which is an element forming a carbonitride, is added to an ultra-low carbon steel; hot rolling is performed at a temperature not higher than the $Ar_3$ transformation point (also referred to as $Ar_3$ point), namely, in an a region; and annealing is not performed after the cold rolling. However, the steel sheet obtained by the technique of JP '926 is in the state after that the cold rolling has been conducted and is therefore poor in ductility and does not have sufficient workability for some purposes.

As a technique for improving these problems, Japanese Unexamined Patent Application Publication No. 8-41549 discloses a technique for improving ductility by adding Nb and Ti, which are elements forming carbonitrides, to an ultra-low carbon steel and performing hot rolling at a temperature not higher than the $Ar_3$ point, cold rolling, and then low-temperature annealing. The term "low-temperature annealing" used herein is annealing that is performed at a temperature not to cause recrystallization, and, therefore, the energy cost for heating is reduced.

In addition, Japanese Unexamined Patent Application Publication No. 6-248339 discloses a technique involving adding Nb, Ti, Zr, V, and B, which are elements forming carbonitrides, to an ultra-low carbon steel and performing hot rolling at a temperature not higher than the $Ar_3$ point, cold rolling, and then annealing at a temperature not higher than the recrystallization temperature.

The characteristics common in JP '926, JP '549 and JP '339 are that an ultra-low carbon steel is used as the steel; elements forming carbonitrides are added; and the hot rolling is performed at a temperature not higher than the $Ar_3$ point. However, the steel sheets manufactured under these conditions have a problem of insufficient uniformity in thickness in the longitudinal direction of the steel sheet coil.

In JP '549 and JP '339, steel sheets having high strength are obtained by performing annealing not involving recrystallization. In the hot rolling performed in these technologies, rolling of 40% or 50% or more is performed at a temperature not higher than the $Ar_3$ point. In such a case, even if the annealing does not involve recrystallization, a TS of 600 to 850 MPa, which is desirable, cannot be obtained.

It could therefore be helpful to provide a method of manufacturing a steel sheet for cans having high strength and ductility necessary for a canning process, while inhibiting the variation in thickness in the longitudinal direction of the steel sheet coil.

SUMMARY

We thus provide:

(1) a method of manufacturing a steel sheet for cans, the method including providing a slab by continuous casting of a steel having a component composition of, in mass %, C: 0.005% or less, Mn: 0.05 to 0.5%, Al: 0.01 to 0.10%, N: 0.0010 to 0.0070%, B: 0.15×N to 0.75×N (0.15 to 0.75 in terms of B/N), and one or both of Nb: 4×C to 20×C (4 to 20 in terms of Nb/C) and Ti: 2×C to 10×C (2 to 10 in terms of Ti/C), and the balance of Fe and inevitable impurity elements; rough rolling the slab; finish rolling the rough-rolled slab wherein 5% or more and less than 50% of the total amount of rolling reduction in the finish rolling is hot-rolled at a temperature lower than the $Ar_3$ transformation point; winding the hot-rolled steel sheet at a winding temperature of 640 to 750° C.; pickling the coiled steel sheet; cold rolling the pickled steel sheet at a rolling reduction rate of 88 to 96%; and annealing the cold-rolled steel sheet in a temperature range of higher than 400° C. to a temperature that is 20° C. lower than the recrystallization temperature.

A steel sheet having high strength and ductility necessary for a canning process and a reduced variation in thickness in the longitudinal direction of the steel sheet coil can be obtained.

DETAILED DESCRIPTION

Our methods will be described in detail below.

We investigated thickness variation in the longitudinal direction of a steel sheet coil when an ultra-low carbon steel containing carbonitride-forming elements are hot-rolled at a temperature of the $Ar_3$ point or less and is further cold-rolled. Our findings are described in detail below.

First, reasons for limiting each steel component will be described.

Note that % used in each steel component all means mass %.

C: 0.005% or less

We provide a method of manufacturing a steel sheet for cans having high strength and also ductility by performing annealing not involving recrystallization. To achieve this, it is necessary to use an ultra-low carbon steel containing carbon in a reduced amount as a steel component, carbon deteriorating ductility. When the amount of C is higher than 0.005%, the ductility is reduced to be unsuitable for a canning process. Consequently, the C content is determined to be 0.005% or less, preferably, 0.003% or less. Incidentally, a lower C content is desirable, but decarburization for reducing C content takes a long time, resulting in an increase in the manufacturing cost. Therefore, the lower limit of the C content is preferably 0.0005% or more, more preferably, 0.0015% or more.

Mn: 0.05 to 0.5%

When the Mn content is lower than 0.05%, it is difficult to avoid so-called "high-temperature brittleness," even if the S content is decreased, which may cause problems such as surface cracking On the other hand, when the Mn content is higher than 0.5%, the transformation point becomes too low, which makes it difficult to obtain a desirable structure when rolling is conducted at a temperature of not higher than the transformation point. Therefore, the Mn content is determined to be 0.05% or more and 0.5% or less. Incidentally, when the workability is particularly regarded as an important factor, the Mn content is preferably 0.20% or less.

S: 0.008% or less (preferred condition)

S does not particularly affect the properties of the steel sheet. However, when the amount of S is higher than 0.008% and also the amount of N is higher than 0.0044%, nitrides and carbonitrides, i.e., BN, Nb(C,N), and AlN, precipitate using MnS, which has been generated in a large amount, as precipitation nuclei, resulting in a decrease in hot ductility. Therefore, the S content is desirably 0.008% or less.

Al: 0.01 to 0.10%

When the Al amount is lower than 0.01%, a sufficient deoxidation effect cannot be obtained. In addition, an effect decreasing the N solid solution in the steel by forming AlN with N is not sufficiently obtained. On the other hand, when the content is higher than 0.10%, these effects saturate, and inclusions such as alumina tend to be generated. Therefore, the Al amount is determined to be 0.01% or more and 0.10% or less.

N: 0.0010 to 0.0070%

When the amount of N is lower than 0.0010%, the manufacturing cost of the steel sheet is increased, and also stable manufacturing is difficult. In addition, the ratio of B and N is important as described below. When the amount of N is small, it is difficult to control the amount of B for adjusting the ratio of B and N to a certain range. On the other hand, when the amount of N is higher than 0.0070%, the hot ductility of the steel is deteriorated. This is caused by embrittlement due to precipitation of nitrides and carbonitrides, such as BN, Nb(N, C), and AlN, when the N amount is higher than 0.0070%. In particular, a risk of occurrence of slab cracking during continuous casting is increased. If slab cracking occurs, a step of cutting the corner of the slab cracking portion or grinding it with a grinder is necessary. Since this requires a large amount of labor and costs, productivity is highly decreased. Therefore, the N amount is determined to be 0.0010% or more and 0.0070% or less, preferably, 0.0044% or less.

B: 0.15×N to 0.75×N

B is an important element that largely affects the properties of a steel sheet wherein (1) an ultra-low carbon steel is used as the steel, (2) carbonitride-forming elements are added, and (3) hot-rolling is performed at a temperature of not higher than the $Ar_3$ point. However, the steel sheets manufactured under these conditions still have a problem that thickness uniformity in the longitudinal direction of the steel sheet coil is insufficient. Accordingly, as a result of detailed investigation of this phenomenon, we found that satisfactory thickness uniformity in the longitudinal direction of a steel sheet coil can be obtained by adding an appropriate amount of B to the steel. This is probably based on the following mechanism. First, the non-uniformity in the thickness in the longitudinal direction of the steel sheet coil occurs in the hot-rolled steel sheet. We believe that in an ultra-low carbon steel containing a carbonitride-forming element, the deformation resistance is discontinuously changed when the austenite is transformed into ferrite at the $Ar_3$ point and therefore that the interstand tension and the rolling load vary by occurrence of the transformation between hot-rolling stands, resulting in a variation in the thickness. We believe that the addition of B inhibits the discontinuous change in the deformation resistance and thereby the thickness uniformity is improved. That is, an important aspect is that the discontinuous change in deformation resistance is inhibited by appropriately regulating the addition amount of B. As a result of the investigation, we found that the addition amount of B has to be determined in a proper relationship with the addition amount of N forming BN and that the necessary amount of B for obtaining the effect is 0.15×N or more in terms of mass ratio. On the other hand, if B is added in an amount of 0.75×N or more in term of mass %, the above-mentioned effect is saturated and also the cost is increased. Therefore, the addition amount of B is determined to be 0.15×N to 0.75×N (0.15 to 0.75 in terms of B/N).

One or both of Nb: 4×C to 20×C and Ti: 2×C to 10×C

Nb is a carbonitride-forming element and has effects of decreasing C and N solid solutions by fixing C and N in the steel as precipitates and accelerating recovery during annealing described below. An addition amount of 4×C or more in terms of mass ratio is necessary to sufficiently exhibit the effects. On the other hand, when the Nb addition amount is too large, the function of decreasing the C solid solution is saturated and also the manufacturing cost is increased because that Nb is expensive. Therefore, it is necessary to control the Nb amount to be 20×C or less. Consequently, the Nb amount is within the range of 4×C to 20×C in terms of mass ratio (4 to 20 in terms of Nb/C).

Ti is a carbonitride-forming element and has effects of decreasing C and N solid solutions by fixing C and N in the steel as precipitates and accelerating recovery during annealing described below. An addition amount of 2×C or more in terms of mass ratio is necessary to sufficiently exhibit the effects. On the other hand, when the Ti addition amount is too large, the function of decreasing the C solid solution is saturated and also the manufacturing cost is increased because that Ti is expensive. Therefore, it is necessary to control the Ti amount to be 10×C or less. Consequently, the Ti amount is within the range of 2×C to 10×C in terms of mass ratio (2 to 10 in terms of Ti/C).

In addition, the balance other than the above-mentioned components is Fe and inevitable impurities. As the inevitable impurities, for example, the following elements may be contained in the ranges that the functional effects are not impaired.

Si: 0.020% or less

When the Si content is higher than 0.020%, the surface texture of a steel sheet is impaired, which is undesirable as a surface-treated steel sheet and makes the steel harden, resulting in difficulty in hot rolling. Therefore, the Si content is preferably 0.020% or less.

P: 0.020% or less

A reduction of the P content improves workability and corrosion resistance, but an excessive reduction causes an increase in the manufacturing cost. From the balance between them, the P content is preferably 0.020% or less.

In addition to the above-mentioned components, inevitable impurities such as Cr and Cu are contained, but these components do not particularly affect the steel sheet properties. Therefore, they can be arbitrarily contained in the ranges that do not affect other properties. In addition, elements other than the components mentioned above may be contained in the ranges that do not affect the steel sheet properties.

Next, the reasons for limiting manufacturing conditions will be described.

The steel sheet for cans is obtained by providing a slab by continuous casting of a steel having chemical components adjusted to the above-described ranges; rough rolling the slab; finish rolling the rough-rolled slab wherein 5% or more and less than 50% of the total amount of rolling reduction in the finish rolling is hot-rolled at a temperature lower than the $Ar_3$ transformation point; winding the hot-rolled steel sheet at a winding temperature of 640 to 750° C.; pickling the coiled steel sheet; cold rolling the pickled steel sheet at a rolling reduction rate of 88 to 96%; and annealing the cold-rolled steel sheet in a temperature range of higher than 400° C. to a temperature that is 20° C. lower than the recrystallization temperature. These will be described in detail below.

The hot-rolling conditions, that is, 5% or more and less than 50% of the total amount of rolling reduction in the finish rolling is hot-rolled at a temperature lower than the $Ar_3$ transformation point, are important requirements. The targeted final thickness after the cold rolling is about 0.14 to 0.15 mm, at least 0.18 mm or less. Therefore, the thickness of a hot-rolled steel sheet is desirably 3.0 mm or less, considering the load in the cold rolling. In the case of a hot-rolled steel sheet having a thickness such a degree, to ensure a finishing temperature not lower than the $Ar_3$ transformation point entirely in the width direction of the hot-rolled steel sheet, a temperature difference between edge portions in the width direction, the temperatures of which tend to decrease, and the central portion in the width direction, the temperature of which hardly decreases, occurs in some cases, resulting in a difficulty in obtaining uniform material properties. In this respect, by performing the hot rolling at a relatively low temperature of lower than the $Ar_3$ transformation point, the temperature difference in the width direction can be relatively reduced to homogenize the material properties. Accordingly, the hot rolling is performed at a temperature not lower than the $Ar_3$ transformation point excluding 5% or more and less than 50% of the total amount of rolling reduction in the finish rolling. However, the hot rolling at a temperature lower than the $Ar_3$ transformation point causes a problem of inferior uniformity in thickness in the longitudinal direction of the steel sheet coil. Therefore, as described above, this problem is solved by adding an appropriate amount of B.

Furthermore, in the finish rolling, 5% or more and less than 50% of the total amount of rolling reduction in the finish rolling is hot-rolled at a temperature lower than the $Ar_3$ transformation point. This is because we target a TS of 600 to 850 MPa after cold rolling and the annealing not involving recrystallization. The hot rolling at a temperature lower than the $Ar_3$ transformation point in the finish rolling has a tendency to coarsen the grain diameter of the hot-rolled steel sheet to reduce the strength of the hot-rolled steel sheet. Therefore, the strength after the cold rolling and after the annealing not involving recrystallization is also reduced. This tendency is particularly significant when 50% or more of the total amount of rolling reduction in the finish rolling is hot-rolled at a temperature lower than the $Ar_3$ transformation point in the finish rolling, and a TS of 600 to 850 MPa is not achieved.

It is believed that when 50% or more of the total amount of rolling reduction in the finish rolling is hot-rolled at a temperature lower than the $Ar_3$ transformation point in the finish rolling, the α-phase after the hot rolling is completely recrystallized by using the strain introduced by a relatively high rolling rate as the driving force and becomes a grain grown α-phase. The recrystallization and grain growth induced by the strain are inhibited by performing hot rolling at a temperature lower than the $Ar_3$ transformation point for less than 50% of the total amount of rolling reduction in the finish rolling to inhibit coarsening of the grain diameter and reduction of the hardness of the hot-rolled steel sheet. Furthermore, the strength after the cold rolling and after the annealing not involving recrystallization is also inhibited from reducing to give the desired strength.

On the other hand, the rolling at a temperature lower than the $Ar_3$ transformation point is at least 5% or more of the total amount of rolling reduction in the finish rolling. In a rolling reduction amount of less than 5%, the rolling reduction at a temperature not lower than the $Ar_3$ transformation point is 95% or more of the total amount of the rolling reduction, which causes heterogeneous thickness and material properties when non-uniform temperature is caused in the width direction of the steel sheet.

The hot rolling of 5% or more and less than 50% of the total amount of rolling reduction in the finish rolling is as follows. In a case that a slab having a thickness of 250 mm is manufactured by continuous casting, the slab is reheated in a heating furnace and then is rough-rolled into a rough bar having a thickness of 35 mm, and then the rough bar is finish-rolled, when the thickness after the finish rolling is 2.0 mm, the total amount of rolling reduction in the finish rolling is, since the thickness is reduced to 2.0 mm from 35 mm, 33 mm. Of this, the hot rolling of less than 50% of the total amount of rolling reduction performed at a temperature lower than the $Ar_3$ transformation point corresponds to, since 50% of 33 mm is 16.5 mm, that rolling from a thickness smaller than 18.5 mm (16.5+2 mm) to a thickness of 2.0 mm, which is the thickness after the finish rolling, is performed at a temperature lower than the $Ar_3$ transformation point. And also the hot rolling of not less than 5% of the total amount of rolling reduction performed at a temperature lower than the $Ar_3$ transformation point corresponds to, since 5% of 33 mm is 1.65 mm, that rolling from a thickness not smaller than 3.65 mm (1.65+2 mm) to a thickness of 2.0 mm, which is the thickness after the finish rolling, is performed at a temperature lower than the $Ar_3$ transformation point.

In addition, the $Ar_3$ transformation point can be determined as a temperature that causes a change in volume accompanied by $Ar_3$ transformation when a heat processing treatment test for reproducing processing and thermal history at hot-rolling is conducted. The $Ar_3$ transformation point of steel components satisfying the requirements is approximately 900° C., and the finishing temperature may be any temperature lower than this and is desirably 860° C. or less for certainly achieving such a temperature. In actual hot rolling, a steel that is comparable to the objective steel in the components and the thermal history is measured for the $Ar_3$ transformation temperature in advance by the above-described method, and the cooling water amount, the rolling speed, and so on are controlled so that 5% or more and less than 50% of the total amount of rolling reduction is hot-rolled at a temperature lower than the $Ar_3$ transformation point.

Furthermore, a finish rolling mill entry temperature of 950° C. or less enables the hot rolling to be certainly controlled to the $Ar_3$ transformation point or less and the structure to be uniform, which is more preferred. Details of the mechanism are not sufficiently revealed, but it is suggested that austenite grain diameter immediately before the start of finish rolling is involved in it. From the viewpoint of preventing occurrence of scale defects, the temperature is preferably controlled to 920° C. or less.

Winding temperature: 640 to 750° C.

It is necessary to adjust the winding temperature not to cause any hindrance in the subsequent steps, pickling and cold rolling. That is, if winding is performed at a temperature higher than 750° C., problems, such as a significant increase in the scale thickness of the steel sheet, deterioration of descalability in pickling, and coil deformation along with a decrease in high-temperature strength of the steel sheet itself, may occur. On the other hand, if the winding temperature is lower than 640° C., NbC is not precipitated not to decrease the C solid solution, which deteriorates ductility. From the above, the winding temperature is determined to be 640° C. or higher and less than 750° C.

The hot-rolled steel sheet after pickling and winding is subjected to pickling for scale removing before cold rolling. The pickling may be performed according to a common process.

Cold-rolling condition after pickling: rolling reduction rate of 88 to 96%

The cold rolling after pickling is performed at a rolling reduction rate of 88 to 96%. When the rolling reduction rate is lower than 88%, the thickness of the hot-rolled steel sheet has to have a thickness of 1.6 mm or less, and it is difficult to ensure homogeneous temperature of the hot-rolled steel sheet even if other requirements are satisfied. Furthermore, the upper limit depends on the strength and thickness required in a product and ability of facilities for hot rolling and cold rolling, but rolling at a rolling reduction of higher than 96% makes it difficult to avoid reduction in ductility.

Annealing after cold rolling: higher than 400° C. and not higher than a temperature that is 20° C. lower than the recrystallization starting temperature The heat treatment (annealing) is performed in a temperature range of higher than 400° C. and not higher than a temperature that is 20° C. lower than the recrystallization starting temperature. The purpose of annealing is to recover ductility by releasing strain introduced by the cold rolling. A temperature of 400° C. cannot sufficiently release the strain to insufficiently recover the ductility. On the other hand, a temperature of higher than recrystallization temperature forms recrystallized grains not to provide a strength that is targeted by our method. Furthermore, since a temperature just below the recrystallization temperature causes a sharp change in strength with respect to a change in temperature, a uniform strength over the entire steel sheet is hardly obtained. Accordingly, the upper limit of temperature that can provide homogeneous material properties is set to a temperature that is 20° C. lower than the recrystallization starting temperature. Note that the recrystallized grains and only recovered grains can be discriminated from each other by observation with an optical or electronic microscope. The more preferred upper limit of the temperature from the viewpoint of ensuring the strength is a temperature that is 30° C. lower than the recrystallization starting temperature. The recrystallization temperature is a temperature at which recrystallized grains can be identified by observation with an optical or electronic microscope.

Note that the recrystallization starting temperature when the steel sheet composition and the cold-rolling conditions are approximately 650 to 690° C. The targeted temperature can be achieved by adjusting the soaking time in the annealing to 10 seconds or longer and 90 seconds or shorter. Since the annealing is performed for such a soaking time, the annealing is preferably performed in a continuous annealing furnace.

EXAMPLE 1

Examples will be described below.

Slabs having a thickness of 250 mm were produced from various steels containing components shown in Table 1, heated at a heating temperature of 1100 to 1250° C., and then rough-rolled to rough bars having a thickness of 35 mm. The rough bars were hot-rolled under hot-rolling conditions shown in Table 2, that is, the finishing temperatures, the rolling reduction amounts at a temperature lower than $Ar_3$ transformation point (ratio to the total amount of rolling reduction in the finish rolling), and the winding temperatures. Then, the steel sheets were pickled, cold-rolled at rolling rates shown in table 2, and annealed at annealing temperatures for a soaking time of 10 to 45 seconds.

TABLE 1

| | C | Si | Mn | P | S | Sol. Al | N | Nb | Ti | B | mass ratio Nb/C | Ti/C | B/N | Note |
|---|---|---|---|---|---|---|---|---|---|---|---|---|---|---|
| 1 | 0.0016 | 0.01 | 0.28 | 0.010 | 0.011 | 0.046 | 0.0024 | 0.011 | — | 0.0012 | 7 | — | 0.50 | Example |
| 2 | 0.0015 | 0.01 | 0.29 | 0.009 | 0.011 | 0.043 | 0.0026 | 0.016 | — | 0.0012 | 11 | — | 0.46 | Example |
| 3 | 0.0017 | 0.01 | 0.28 | 0.009 | 0.011 | 0.045 | 0.0022 | 0.022 | — | 0.0011 | 13 | — | 0.50 | Example |
| 4 | 0.0017 | 0.01 | 0.28 | 0.009 | 0.011 | 0.045 | 0.0022 | 0.022 | — | 0.0011 | 13 | — | 0.50 | Comparative Example |
| 5 | 0.0017 | 0.01 | 0.28 | 0.009 | 0.011 | 0.045 | 0.0022 | 0.022 | — | 0.0011 | 13 | — | 0.50 | Comparative Example |
| 6 | 0.0049 | 0.01 | 0.72 | 0.011 | 0.011 | 0.055 | 0.0025 | 0.029 | — | 0.0011 | 6 | — | 0.44 | Comparative Example |
| 7 | 0.0058 | 0.01 | 0.29 | 0.010 | 0.012 | 0.052 | 0.0023 | 0.022 | — | 0.0013 | 4 | — | 0.57 | Comparative Example |
| 8 | 0.0029 | 0.01 | 0.28 | 0.008 | 0.011 | 0.050 | 0.0019 | 0.010 | — | 0.0013 | 3 | — | 0.68 | Comparative Example |
| 9 | 0.0019 | 0.01 | 0.28 | 0.009 | 0.011 | 0.050 | 0.0019 | 0.014 | — | 0.0014 | 7 | — | 0.74 | Example |
| 10 | 0.0019 | 0.01 | 0.28 | 0.009 | 0.010 | 0.050 | 0.0020 | 0.061 | — | 0.0012 | 32 | — | 0.60 | Comparative Example |
| 11 | 0.0025 | 0.01 | 0.29 | 0.009 | 0.010 | 0.048 | 0.0024 | 0.057 | — | 0.0011 | 23 | — | 0.46 | Comparative Example |
| 12 | 0.0029 | 0.01 | 0.28 | 0.009 | 0.011 | 0.046 | 0.0009 | 0.022 | — | 0.0008 | 8 | — | 0.89 | Comparative Example |
| 13 | 0.0018 | 0.01 | 0.30 | 0.009 | 0.010 | 0.043 | 0.0012 | 0.030 | — | 0.0008 | 17 | — | 0.67 | Example |
| 14 | 0.0031 | 0.01 | 0.31 | 0.010 | 0.011 | 0.042 | 0.0067 | 0.022 | — | 0.0012 | 7 | — | 0.18 | Example |
| 15 | 0.0028 | 0.01 | 0.31 | 0.009 | 0.011 | 0.040 | 0.0068 | 0.019 | — | 0.0021 | 7 | — | 0.31 | Example |
| 16 | 0.0023 | 0.01 | 0.31 | 0.008 | 0.011 | 0.039 | 0.0074 | 0.025 | — | 0.0009 | 11 | — | 0.12 | Comparative Example |
| 17 | 0.0022 | 0.01 | 0.29 | 0.014 | 0.013 | 0.036 | 0.0020 | 0.021 | — | 0.0010 | 10 | — | 0.50 | Example |
| 18 | 0.0022 | 0.01 | 0.29 | 0.014 | 0.013 | 0.036 | 0.0020 | 0.021 | — | 0.0010 | 10 | — | 0.50 | Example |
| 19 | 0.0022 | 0.01 | 0.29 | 0.014 | 0.013 | 0.036 | 0.0020 | 0.021 | — | 0.0010 | 10 | — | 0.50 | Comparative Example |
| 20 | 0.0020 | 0.01 | 0.33 | 0.010 | 0.010 | 0.036 | 0.0025 | 0.024 | — | 0.0018 | 12 | — | 0.72 | Comparative Example |
| 21 | 0.0022 | 0.01 | 0.29 | 0.014 | 0.013 | 0.036 | 0.0020 | 0.021 | — | 0.0010 | 10 | — | 0.50 | Comparative Example |
| 22 | 0.0020 | 0.01 | 0.33 | 0.010 | 0.010 | 0.036 | 0.0025 | 0.024 | — | 0.0018 | 12 | — | 0.72 | Comparative Example |
| 23 | 0.0025 | 0.01 | 0.33 | 0.010 | 0.011 | 0.036 | 0.0025 | 0.020 | — | 0.0023 | 8 | — | 0.92 | Comparative Example |
| 24 | 0.0033 | 0.01 | 0.28 | 0.010 | 0.012 | 0.009 | 0.0023 | 0.025 | — | 0.0013 | 8 | — | 0.57 | Comparative Example |
| 25 | 0.0031 | 0.01 | 0.28 | 0.010 | 0.011 | 0.100 | 0.0023 | 0.025 | — | 0.0012 | 8 | — | 0.52 | Example |
| 26 | 0.0030 | 0.01 | 0.28 | 0.010 | 0.012 | 0.046 | 0.0023 | 0.023 | — | 0.0013 | 8 | — | 0.57 | Example |
| 27 | 0.0031 | 0.01 | 0.28 | 0.010 | 0.012 | 0.049 | 0.0023 | 0.025 | — | 0.0011 | 8 | — | 0.48 | Example |
| 28 | 0.0015 | 0.01 | 0.28 | 0.009 | 0.011 | 0.044 | 0.0025 | — | 0.002 | 0.0013 | — | 1.3 | 0.52 | Comparative Example |
| 29 | 0.0029 | 0.01 | 0.28 | 0.009 | 0.011 | 0.046 | 0.0023 | — | 0.022 | 0.0013 | — | 7.6 | 0.57 | Example |
| 30 | 0.0024 | 0.01 | 0.28 | 0.009 | 0.010 | 0.055 | 0.0019 | — | 0.022 | 0.0013 | — | 9 | 0.68 | Example |
| 31 | 0.0019 | 0.01 | 0.30 | 0.010 | 0.011 | 0.041 | 0.0065 | — | 0.018 | 0.0014 | — | 9 | 0.22 | Example |
| 32 | 0.0025 | 0.01 | 0.33 | 0.010 | 0.010 | 0.036 | 0.0025 | — | 0.022 | 0.0018 | — | 9 | 0.72 | Example |
| 33 | 0.0018 | 0.01 | 0.28 | 0.009 | 0.011 | 0.046 | 0.0023 | 0.022 | 0.029 | 0.0013 | 12 | 16 | 0.57 | Example |
| 34 | 0.0049 | 0.01 | 0.72 | 0.011 | 0.011 | 0.055 | 0.0025 | 0.013 | 0.023 | 0.0011 | 3 | 5 | 0.44 | Comparative Example |
| 35 | 0.0029 | 0.01 | 0.28 | 0.009 | 0.011 | 0.050 | 0.0019 | 0.014 | 0.022 | 0.0014 | 5 | 8 | 0.74 | Example |
| 36 | 0.0019 | 0.01 | 0.29 | 0.010 | 0.011 | 0.044 | 0.0012 | 0.025 | 0.015 | 0.0005 | 13 | 8 | 0.42 | Example |
| 37 | 0.0018 | 0.01 | 0.28 | 0.009 | 0.011 | 0.046 | 0.0009 | 0.022 | 0.017 | 0.0008 | 12 | 9 | 0.89 | Comparative Example |
| 38 | 0.0019 | 0.01 | 0.28 | 0.009 | 0.011 | 0.046 | 0.0040 | 0.022 | — | 0.0010 | 12 | — | 0.25 | Comparative Example |
| 39 | 0.0029 | 0.01 | 0.28 | 0.009 | 0.011 | 0.046 | 0.0040 | — | 0.022 | 0.0010 | — | 8 | 0.25 | Comparative Example |
| 40 | 0.0029 | 0.01 | 0.28 | 0.009 | 0.011 | 0.046 | 0.0040 | 0.022 | 0.029 | 0.0010 | 8 | 10 | 0.25 | Comparative Example |
| 41 | 0.0029 | 0.01 | 0.28 | 0.009 | 0.011 | 0.046 | 0.0040 | 0.010 | — | 0.0010 | 3 | — | 0.25 | Comparative Example |
| 42 | 0.0029 | 0.01 | 0.28 | 0.009 | 0.011 | 0.046 | 0.0040 | — | 0.004 | 0.0010 | — | 1 | 0.25 | Comparative Example |
| 43 | 0.0029 | 0.01 | 0.28 | 0.009 | 0.011 | 0.046 | 0.0040 | 0.022 | 0.029 | 0.0003 | 8 | 10 | 0.08 | Comparative Example |

First, the thus-obtained steel sheets were evaluated for thickness variation.

The thickness variation was evaluated using the coefficient of variation of the average thickness by measuring thickness after cold rolling over the entire length in the longitudinal direction of a steel sheet coil with an X-ray thickness gauge set to a cold-rolling facility. One having a coefficient of variation of ±3% or less was determined to be acceptable as a product and shown by ○, and one having a coefficient of variation of higher than ±3% was determined not to be acceptable and shown by X. Furthermore, those having a thickness variation of 3% or less were subjected to a tensile test in accordance with JIS Z 2241 for evaluating tensile strength (TS) and elongation (El). Regarding the tensile strength, one having a strength of 600 MPa or more and 850 MPa or less, which is the target level, was determined to be acceptable and shown by ○, and one other than the above was shown by X. Regarding the elongation (El), one elongated by 4% or more, which is the target level, was determined to be acceptable and shown by ○, and one other than the above was shown by X. The results are shown in Table 2 together with the manufacturing conditions.

TABLE 2

| | Finishing temperature (° C.) | Finishing temperature: Lower than $Ar_3$: ○ Not lower than $Ar_3$: x | Rolling reduction amount: Rolling reduction rate (%) at a temp. lower than $Ar_3$ | Winding temperature (° C.) | Cold-rolling rate (%) | Annealing temperature (° C.) | Recrystallization starting temperature (° C.) | Variation in thickness: Not larger than ±3%: ○ Larger than ±3%: x | TS (MPa) | El (%) | Comprehensive evaluation | Note |
|---|---|---|---|---|---|---|---|---|---|---|---|---|
| 1 | 820 | ○ | 45 | 650 | 92 | 650 | 680 | ○ | 610 | 6.5 | ○ | Example |
| 2 | 820 | ○ | 38 | 650 | 92 | 660 | 680 | ○ | 620 | 6.5 | ○ | Example |
| 3 | 820 | ○ | 38 | 650 | 92 | 650 | 680 | ○ | 650 | 5.3 | ○ | Example |
| 4 | 820 | ○ | 55 | 650 | 92 | 660 | 680 | ○ | 590 | 7.0 | x | Comparative Example |
| 5 | 820 | ○ | 80 | 650 | 91 | 660 | 680 | ○ | 570 | 7.5 | x | Comparative Example |
| 6 | 855 | x | 0 | 640 | 91 | 650 | 670 | x | — | — | x | Comparative Example |
| 7 | 820 | ○ | 45 | 640 | 91 | 640 | 670 | ○ | 670 | 2.0 | x | Comparative Example |
| 8 | 820 | ○ | 45 | 650 | 90 | 690 | 680 | ○ | 560 | 7.0 | x | Comparative Example |
| 9 | 820 | ○ | 48 | 650 | 90 | 660 | 700 | ○ | 640 | 6.0 | ○ | Example |
| 10 | 820 | ○ | 48 | 620 | 88 | 660 | 680 | ○ | 620 | 2.2 | x | Comparative Example |
| 11 | 820 | ○ | 48 | 590 | 88 | 650 | 680 | ○ | 660 | 2.0 | x | Comparative Example |
| 12 | 820 | ○ | 25 | 650 | 88 | 680 | 700 | x | — | — | x | Comparative Example |
| 13 | 820 | ○ | 38 | 650 | 92 | 600 | 680 | ○ | 700 | 4.9 | ○ | Example |
| 14 | 820 | ○ | 25 | 650 | 92 | 550 | 680 | ○ | 750 | 4.5 | ○ | Example |
| 15 | 820 | ○ | 38 | 650 | 93 | 500 | 680 | ○ | 780 | 4.2 | ○ | Example |
| 16 | 820 | ○ | 38 | 680 | 93 | 550 | 680 | x | — | — | x | Comparative Example |
| 17 | 820 | ○ | 38 | 700 | 93 | 655 | 680 | ○ | 680 | 5.6 | ○ | Example |
| 18 | 820 | ○ | 8 | 650 | 93 | 655 | 680 | ○ | 750 | 4.0 | ○ | Example |
| 19 | 820 | ○ | 4 | 680 | 92 | 650 | 680 | x | — | — | x | Comparative Example |
| 20 | 820 | ○ | 2 | 680 | 92 | 650 | 680 | x | — | — | x | Comparative Example |
| 21 | 820 | ○ | 40 | 650 | 85 | 650 | 685 | x | — | — | x | Comparative Example |
| 22 | 820 | ○ | 40 | 650 | 97 | 650 | 685 | ○ | 800 | 2.8 | x | Comparative Example |
| 23 | 820 | ○ | 48 | 650 | 89 | 650 | 685 | x | — | — | x | Comparative Example |
| 24 | 800 | ○ | 40 | 650 | 89 | 380 | 680 | ○ | 850 | 2.5 | x | Comparative Example |
| 25 | 800 | ○ | 40 | 650 | 89 | 410 | 680 | ○ | 810 | 4.0 | ○ | Example |
| 26 | 800 | ○ | 40 | 650 | 89 | 500 | 680 | ○ | 720 | 4.3 | ○ | Example |
| 27 | 800 | ○ | 40 | 650 | 89 | 600 | 680 | ○ | 680 | 5.2 | ○ | Example |
| 28 | 800 | ○ | 35 | 680 | 89 | 630 | 680 | ○ | 670 | 3.3 | x | Comparative Example |
| 29 | 810 | ○ | 38 | 680 | 89 | 650 | 680 | ○ | 650 | 4.5 | ○ | Example |
| 30 | 810 | ○ | 45 | 740 | 95 | 660 | 685 | ○ | 620 | 7.0 | ○ | Example |
| 31 | 810 | ○ | 38 | 740 | 94 | 660 | 685 | ○ | 610 | 6.6 | ○ | Example |
| 32 | 810 | ○ | 25 | 740 | 93 | 660 | 685 | ○ | 620 | 7.5 | ○ | Example |
| 33 | 820 | ○ | 48 | 700 | 88 | 410 | 690 | ○ | 790 | 4.3 | ○ | Example |
| 34 | 820 | ○ | 38 | 700 | 88 | 610 | 690 | ○ | 700 | 2.2 | x | Comparative Example |
| 35 | 820 | ○ | 38 | 700 | 88 | 500 | 690 | ○ | 750 | 4.5 | ○ | Example |
| 36 | 820 | ○ | 48 | 700 | 88 | 610 | 690 | ○ | 700 | 4.5 | ○ | Example |
| 37 | 820 | ○ | 38 | 680 | 88 | 660 | 690 | x | — | — | x | Comparative Example |
| 38 | 900 | x | 0 | 720 | 89 | 650 | 680 | x | — | — | x | Comparative Example |
| 39 | 890 | x | 0 | 720 | 89 | 650 | 680 | x | — | — | x | Comparative Example |
| 40 | 910 | x | 0 | 720 | 89 | 650 | 670 | x | — | — | x | Comparative Example |
| 41 | 820 | ○ | 48 | 700 | 89 | 660 | 690 | ○ | 660 | 3.0 | x | Comparative Example |

TABLE 2-continued

| | Finishing temperature (° C.) | Lower than $Ar_3$: ○ Not lower than $Ar_3$: x | Rolling reduction amount: Rolling reduction rate (%) at a temp. lower than $Ar_3$ | Winding temperature (° C.) | Cold-rolling rate (%) | Annealing temperature (° C.) | Recrystallization starting temperature (° C.) | Variation in thickness: Not larger than ±3%: ○ Larger than ±3%: x | TS (MPa) | El (%) | Comprehensive evaluation | Note |
|---|---|---|---|---|---|---|---|---|---|---|---|---|
| 42 | 800 | ○ | 38 | 700 | 89 | 660 | 690 | ○ | 660 | 3.0 | x | Comparative Example |
| 43 | 810 | ○ | 25 | 700 | 89 | 660 | 690 | x | — | — | x | Comparative Example |

It is confirmed from Table 2 that thickness variation is inhibited by satisfying the requirements prescribed in Examples and that a steel sheet having the targeted strength and ductility can be obtained.

Industrial Applicability

A steel sheet having high strength and ductility necessary for manufacturing cans and also a reduced variation in thickness in the longitudinal direction of the steel sheet coil can be obtained. Accordingly, we can considerably contribute to industries such as the can manufacturing industry.

The invention claimed is:

1. A method of manufacturing a steel sheet for cans comprising:

providing a slab by continuous casting of a steel having a component composition of, in mass %, C: 0.005% or less, Mn: 0.05 to 0.5%, Al: 0.01 to 0.10%, N: 0.0010 to 0.0070%, B: 0.15×N to 0.75×N (0.15 to 0.75 in terms of B/N), and one or both of Nb: 4×C to 20×C (4 to 20 in terms of Nb/C) and Ti: 2×C to 10×C (2 to 10 in terms of Ti/C), and the balance of Fe and inevitable impurity elements;

rough rolling the slab;

finish rolling the rough-rolled slab wherein 5% or more and less than 50% of the total amount of rolling reduction in the finish rolling is hot-rolled at a temperature lower than the $Ar_3$ transformation point;

winding the hot-rolled steel sheet at a winding temperature of 640 to 750° C.;

pickling the coiled steel sheet;

cold rolling the pickled steel sheet at a rolling reduction rate of 88 to 96%; and annealing the cold-rolled steel sheet in a temperature range of higher than 400° C. to a temperature that is 20° C. lower than the recrystallization temperature.

* * * * *